US010048613B2

(12) United States Patent
Shoji

(10) Patent No.: US 10,048,613 B2
(45) Date of Patent: Aug. 14, 2018

(54) IMAGE FORMING APPARATUS, PRINTING CONTROL METHOD OF THE SAME, AND STORAGE MEDIUM

(71) Applicant: CANON KABUSHIKI KAISHA, Tokyo (JP)

(72) Inventor: Atsushi Shoji, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 64 days.

(21) Appl. No.: 14/992,936

(22) Filed: Jan. 11, 2016

(65) Prior Publication Data

US 2016/0202628 A1 Jul. 14, 2016

(30) Foreign Application Priority Data

Jan. 14, 2015 (JP) ..... 2015-005181

(51) Int. Cl.
*G03G 15/043* (2006.01)
*G03G 15/00* (2006.01)

(52) U.S. Cl.
CPC ..... *G03G 15/043* (2013.01); *G03G 15/556* (2013.01)

(58) Field of Classification Search
None
See application file for complete search history.

(56) References Cited

FOREIGN PATENT DOCUMENTS

| | | | |
|---|---|---|---|
| JP | 2004299239 | A | 10/2004 |
| JP | 2007272153 | A | 10/2007 |
| JP | 2009198727 | A | 9/2009 |

*Primary Examiner* — Lennin Rodriguezgonzale
(74) *Attorney, Agent, or Firm* — Canon U.S.A., Inc. IP Division

(57) ABSTRACT

A process of reducing a toner consumption amount is to be performed on a region within several tens of pixels from a rendering end. An excessive amount of toner is supplied from a toner supplying unit which faces a non-printing region of a photosensitive drum within several tens of pixels at most from an end portion of a printing region. Accordingly, if only contour pixels in the rendering end are processed by an existing processing system, the contour correction and the process of reducing a toner consumption amount may be simultaneously realized. A contour is calculated as a processing result of the existing processing system, and an existing process is performed on a contour portion. The process of reducing a toner consumption amount is performed on other portions.

19 Claims, 15 Drawing Sheets

FIG. 8A

| DISTANCE FROM CONTOUR | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| GRADATION VALUE | 14 | 9 | 9 | 10 | 11 | 11 | 12 | 13 | 14 | 14 | 15 | 15 | 15 | 15 | 15 | 15 | 15 |

FIG. 8B

| DISTANCE FROM CONTOUR | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| GRADATION VALUE | 14 | 9 | 9 | 10 | 10 | 11 | 11 | 12 | 13 | 12 | 14 | 15 | 15 | 15 | 15 | 15 | 15 |
| | 14 | 9 | 10 | 10 | 11 | 11 | 12 | 12 | 12 | 13 | 15 | 15 | 15 | 15 | 15 | 15 | 15 |

IMAGE FORMING APPARATUS, PRINTING CONTROL METHOD OF THE SAME, AND STORAGE MEDIUM

BACKGROUND OF THE INVENTION

Field of the Invention

The present invention relates to an image forming apparatus and a print control method of the image forming apparatus, and particularly relates to a technique of reducing a consumption amount of a developing agent, such as a toner.

Description of the Related Art

In recent years, there is a demand for reducing a toner consumption amount in image forming apparatuses, and a number of methods have been proposed. According to a method disclosed in Japanese Patent Laid-Open No. 2004-299239, a technique of reducing a toner consumption amount by reducing exposure intensity in an image region having a certain area has been proposed. Furthermore, a phenomenon in which a developing toner amount in a rear end portion of a latent image is larger than a developing toner amount in a plane portion of the latent image, which is referred to as "sweeping", occurs. To address this phenomenon, a technique of correcting the sweeping by performing a correction process on image data and controlling an exposure amount is proposed in Japanese Patent Laid-Open No. 2007-272153.

However, the method for controlling exposure intensity of individual pixels is also employed in various image processing techniques in addition to a technique of uniformizing a developing agent.

Examples of the techniques include a contour correction technique of adding subpixels in which exposure amounts thereof are suppressed to a step portion of rendering pixels so that an edge of a binary bit image is more smoothly printed.

The examples of the techniques further include a method for first adding pixels in which exposure amounts thereof are suppressed as pixels added to halftone dots with increase in color density and replacing the pixels in which the exposure amounts thereof are suppressed by pixels of full exposure amounts so that the number of steps in gradation in a certain area is increased.

In recent years, print output apparatuses have a plurality of techniques for enhancing high-quality printing, and the techniques are realized by controlling exposure intensity of pixels.

In a case where an image process of suppressing consumption of a developing agent is additionally performed on a system employing the image process described above, the image processes may interfere with each other and expected results may not be obtained in both of the image processes.

Although the same mechanism is used for the control of exposure amounts of the pixels to reduce a toner consumption amount and the control of exposure amounts of the pixels for image processes, such as contour correction, the exposure amounts of the individual pixels are controlled in accordance with different elements.

Here, a process of reducing exposure amounts performed to reduce a consumption amount of a developing agent and a process of reducing exposure amounts for image processes are to be appropriately adjusted.

To simultaneously realize these image processes and the process of reducing a consumption amount of a developing agent, such as a toner, a technique to be applied to individual pixels is to be determined.

However, since a combination of image processes is changed depending on an operation mode of the print output apparatus, it is difficult to make the determination.

For example, low-resolution rendering is performed so as to perform contour correction in a high-speed printing mode whereas resolution conversion is performed on high-resolution rendering data so that high-resolution rendering data has resolution of a printing mechanism in a high-quality printing mode.

Since different image data is used in different cases, it is difficult to make appropriate determinations for all results of combinations. The determination is more difficult in a case where image processes are successively performed on multivalued image data before a process of reducing a consumption amount of a developing agent is performed. In Japanese Patent Laid-Open No. 2009-198727, a determination is made by performing a binarization process on multivalued data between a registration process and another process so that complication of a determination circuit is avoided.

The present invention provides an image forming apparatus capable of reducing a consumption amount of a developing agent in image periphery portion and efficiently performing image contour correction.

SUMMARY OF THE INVENTION

According to an embodiment of the present invention, there is provided an apparatus including an image bearing member, a charging unit which uniformly charges the image bearing member in accordance with image data, an exposure unit which exposes the image bearing member, a developing unit which develops an electrostatic latent image formed on the image bearing member using a developing agent conveyed by a developing agent bearing member, and a printing unit which prints the developed image. The apparatus includes a first correction unit configured to correct a pixel value of a pixel to be corrected included in the image data, a second correction unit configured to correct a pixel value of a pixel to be corrected included in the image data using a correction method which is different from a correction by the first correction unit, a determination unit configured to determine a pixel to be corrected by the second correction unit, a selection unit configured to determine whether the pixel having a pixel value to be corrected by the second correction unit has been corrected by the first correction unit, and a control unit configured to perform control such that, when the pixel having a pixel value to be corrected by the second correction unit has been corrected by the first correction unit, the exposure unit performs exposure in accordance with image data corrected by the first correction unit, and when the pixel having a pixel value to be corrected by the second correction unit has not been corrected by the first correction unit, the second correction unit corrects the pixel value and the exposure unit performs exposure in accordance with image data corrected by the second correction unit.

Further features of the present invention will become apparent from the following description of exemplary embodiments with reference to the attached drawings.

BRIEF DESCRIPTION OF THE DRAWINGS

FIGS. 8A and 8B are diagrams illustrating correction data.

DESCRIPTION OF THE EMBODIMENTS

Outline of Image Forming Apparatus

Figure 1:
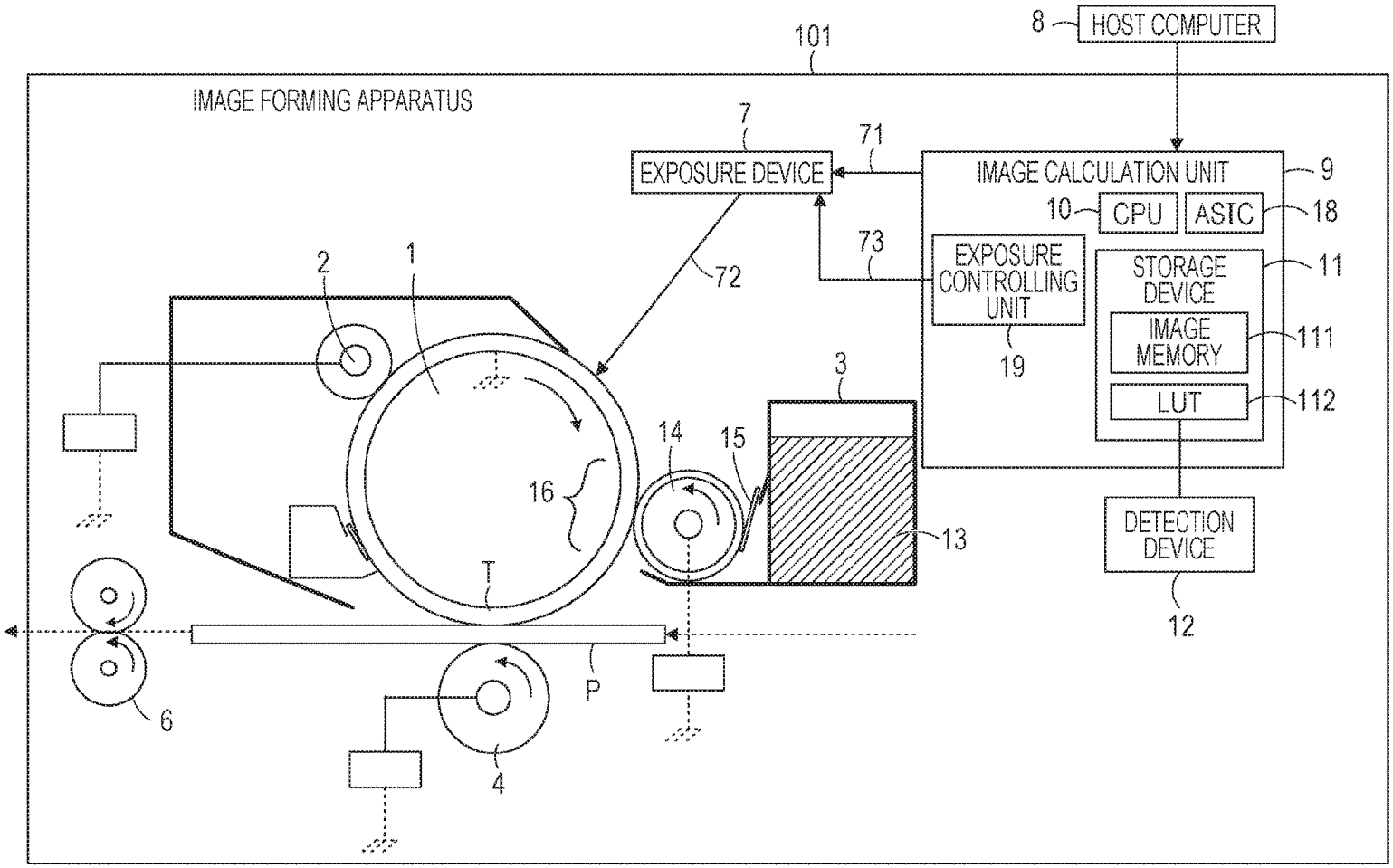
FIG. 1 is a diagram illustrating a configuration of an image forming apparatus according to the present invention.

Operation of an image forming apparatus 101 will be described with reference to FIG. 1. The image forming apparatus 101 includes an electrophotographic photosensitive body 1 having a drum shape (hereinafter referred to as a "photosensitive drum") as an image bearing member. A charging device 2, such as a charging roller, serving as a charging unit uniformly charges a surface of the photosensitive drum 1. An exposure device 7, such as a laser beam scanner device or a light emitting element array, serving as an exposure unit uniformly emit light having an exposure amount based on image data to the photosensitive drum 1 which is uniformly charged so as to expose the photosensitive drum 1.

In this way, the exposure is performed using a laser beam and an electrostatic latent image is formed on the image bearing member, or a surface of the photosensitive drum 1 in the foregoing example, by the exposure. When receiving a driving signal 71 for driving the exposure device 7 supplied from an image calculation unit 9, the exposure device 7 supplies optical information 72 to the photosensitive drum 1 so as to form an electrostatic latent image.

The image calculation unit 9 executes a correction process for reducing a toner consumption amount in accordance with a result of analysis of a shape of a rendering image in addition to a general image generation process and an image process for a printing apparatus of an electrophotographic apparatus. In this embodiment, a toner consumption amount is reduced by suppressing excessive adhesion of a toner caused by an edge effect and sweeping.

The image calculation unit 9 generates image data in accordance with a rendering command specified by a host computer 8 or receives image data supplied from an image scanner or the host computer 8 and executes a correction process on the image data so that a toner consumption amount is reduced.

The edge effect herein is a phenomenon in which a toner is excessively attached in a boundary (an edge) between an exposed portion and an unexposed portion on the surface of the photosensitive drum 1 included in a printing apparatus employing an electrophotographic method of a jumping development method. Surface potentials of the exposed region and the unexposed region are different from each other, and therefore, wrap-around of an electric field is generated in such environments and a toner is excessively attached.

The sweeping is a phenomenon in which a toner is excessively attached to a rear end portion of a printing apparatus employing the electrophotographic method of a contact development method in a conveyance direction of an electrostatic latent image.

Such excessive adhesion of a toner degrades reproducibility of image concentration relative to document concentration, and in addition, causes excessive consumption of a toner. Accordingly, a toner may be saved if excessive consumption of a toner is suppressed.

A CPU 10 is a control unit integrally controlling the entire image forming apparatus 101.

The CPU 10 processes information supplied from an external apparatus, such as the host computer 8, performs reception or generation of image data, performs conversion for the printing apparatus employing the electrophotographic method, and performs overall control of a printing output operation.

The CPU 10 also functions as a correction unit which corrects values of pixels in image data in which the edge effect or the sweeping of a toner may occur among a plurality of pixels constituting the image data so as to reduce the edge effect or the sweeping of a toner. Furthermore, the CPU 10 may function as a specifying unit which specifies pixels to which a toner is excessively attached due to the edge effect or the sweeping of a toner among the plurality of pixels constituting the image data or a determination unit which determines correction amounts.

Some or all of the operations of the CPU 10 described above may be executed by an application specific integrated circuit (ASIC) 18.

A storage device 11 includes an image memory 111 and stores a lookup table (LUT) 112. The mage memory 111 is a storage region (such as a page memory or a line memory) in which image data to be subjected to image formation is developed.

A developing device 3 serving as a developing unit includes a toner container which stocks and stores a developing agent 13, such as a toner, and a developing roller 14 serving as a developing agent bearing member. Although a nonmagnetic monocomponent toner is used as the developing agent 13 here, a two-component toner or a magnetic toner may be employed.

A layer thickness of the developing agent 13 supplied to the developing roller 14 is restricted by a restriction blade 15 functioning as a toner-layer thickness restriction member. The restriction blade 15 may apply charge to the developing agent 13. Then the developing agent 13 supplied to the developing roller 14 is restricted in a predetermined layer thickness, and the developing agent 13 to which a charge of a predetermined amount is applied is supplied to a developing region 16 by the developing roller 14.

In the developing region 16, the developing roller 14 and the photosensitive drum 1 are arranged close to each other or brought into contact with each other and a toner is moved from the developing roller 14 to the photosensitive drum 1 which face each other.

An electrostatic latent image formed on the surface of the photosensitive drum 1 is developed by the developing agent 13 so as to be converted into a toner image. The toner image formed on the surface of the photosensitive drum 1 is transferred to a transfer member P in a transfer position T by a transfer device 4.

The toner image transferred to the transfer member P is supplied to a fixing device 6.

The fixing device 6 applies heat and pressure to the toner image and the transfer member P so as to fix the toner image on the transfer member P.

Development Method

Next, a development method will be described with reference to FIGS. 2A and 2B.

Examples of the development method mainly include the jumping development method and the contact development method.

In the jumping development method, development is performed by a developing voltage (an AC bias voltage obtained by superimposing DC biases with each other) applied to a portion between the developing roller 14 and the photosensitive drum 1 in the developing region 16 which is the closest portion between the developing roller 14 serving as the developing agent bearing member and the photosensitive drum 1 which are maintained in a non-contact state.

Figure 2A:
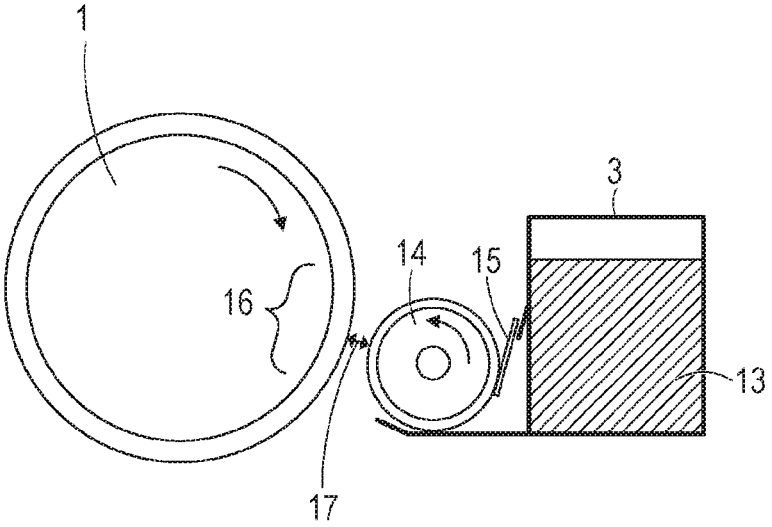
FIGS. 2A and 2B are diagrams illustrating a development method.
Figure 2B:
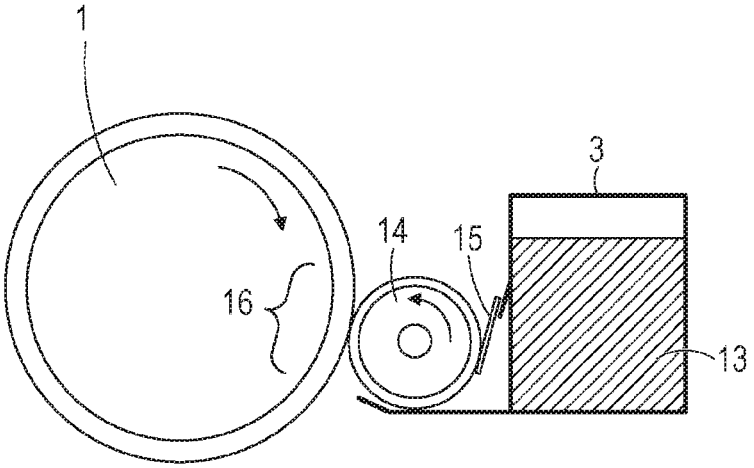

FIG. 2A is a diagram illustrating the developing device 3 employing the jumping development method. The developing device 3 employing the jumping development method has a gap 17 between the developing roller 14 and the photosensitive drum 1 in a development position. If the gap 17 is extremely small, leakage from the developing roller 14 to the photosensitive drum 1 is easily generated, and therefore, development of a latent image is difficult. If the gap 17 is extremely large, the developing agent 13 is difficult to be attached to the photosensitive drum 1. Therefore, an abutting roller which is supported to be rotated by a shaft of the developing roller 14 may maintain the gap 17 of an appropriate size.

In the contact development method, development is performed by a developing voltage (a DC bias) applied to the portion between the developing roller 14 and the photosensitive drum 1 in the developing region 16 which is the closest portion between the developing roller 14 serving as the developing agent bearing member and the photosensitive drum 1 which are in a contact state. FIG. 2B is a diagram illustrating the developing device 3 employing the contact development method.

The photosensitive drum 1 and the developing roller 14 in the contact development method are rotated in a forward direction at different speeds, and therefore, a facing position is gradually shifted.

Furthermore, a DC voltage is applied to the portion between the photosensitive drum 1 and the developing roller 14 as a developing voltage, and a polarity of the developing voltage is the same as that of a charged potential of the surface of the photosensitive drum 1. The developing agent 13 applied to the developing roller 14 as a thin layer is supplied to the developing region 16 and an electrostatic latent image formed on the surface of the photosensitive drum 1 is developed.

Principle of Generation of Edge Effect

Figure 3:
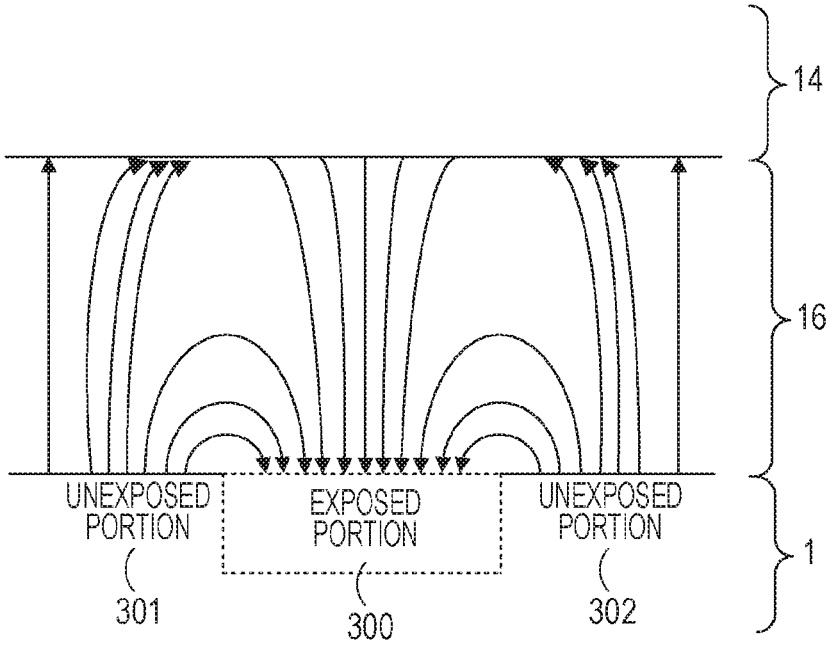
FIG. 3 is a diagram illustrating a state of an electric field in a developing region located between an image bearing member and a toner bearing member.

The edge effect is generated particularly when the jumping development method is employed and is a phenomenon in which the developing agent 13 excessively adheres to an edge of an image since an electric field is concentrated on a boundary between an exposed portion (an electrostatic latent image) and an unexposed portion (a charged portion) which are formed on the photosensitive drum 1. The edge effect will be described as follows in detail with reference to FIG. 3. That is, lines of electric force from unexposed portions 301 and 302 located around an exposed portion 300 wrap around an edge of the exposed portion 300, and therefore, intensity of an electric field at the edge is larger than that at a center of the exposed portion 300. A toner adhering to a non-printing region on a surface of the developing roller 14 is attracted to the edge in addition to a toner in a portion of the developing roller 14 which faces the photosensitive drum 1, and therefore, a larger amount of toner adheres to the edge when compared with that at the center of the exposed portion 300.

Figure 4A:
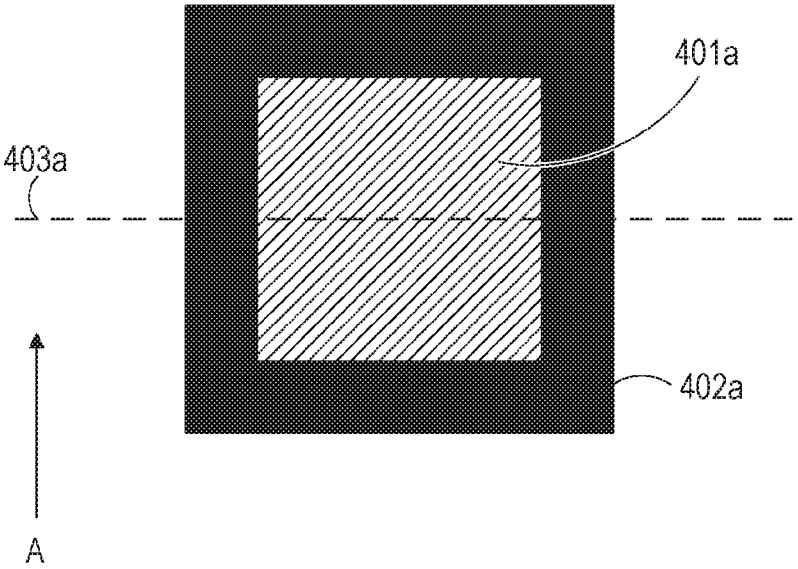
FIGS. 4A and 4B are diagrams illustrating toner images.
Figure 5A:
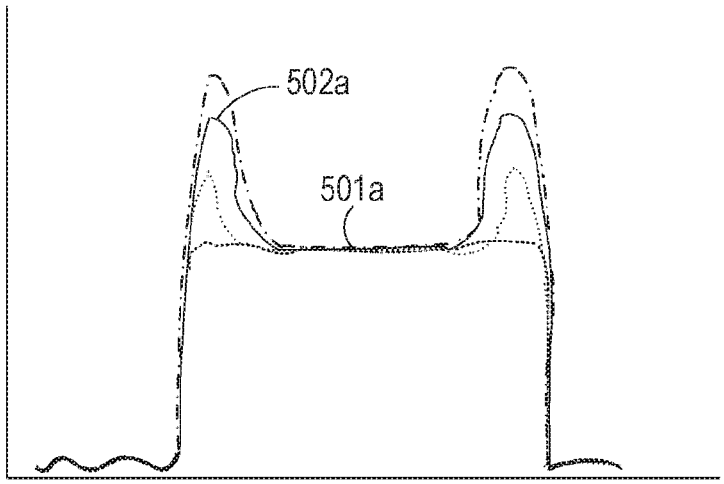
FIGS. 5A and 5B are diagrams illustrating toner heights in the toner images.

FIG. 4A is a diagram illustrating a toner image in a case where the toner excessively adheres since the edge effect is generated. An arrow mark A indicates a direction in which the toner image is conveyed (that is, a direction of rotation of the photosensitive drum 1 and a so-called "sub scanning direction"). In image data which is a base of a toner image 400, the toner image 400 has uniform color density. However, if the edge effect is generated, the developing agent 13 is concentrated on an edge portion 402*a* of the toner image 400. As a result, image density in the edge portion 402*a* is higher than that in a non-edge portion 401*a*. FIG. 5A is a diagram illustrating heights of the attached toner. A reference numeral 501*a* in FIG. 5A corresponds to the non-edge portion 401*a* and a reference numeral 502*a* corresponds to the edge portion 402*a*.

As described above, in the jumping development method, the edge effect is generated since an electric field is concentrated on an edge portion. On the other hand, in the contact development method, an electric field is generated in a direction from the photosensitive drum 1 to the developing roller 14 since the width of the gap 17 is extremely small, and therefore, concentration of the electric field in an edge portion is reduced and the edge effect is less generated.

Principle of Generation of Sweeping

Next, the sweeping generated in the contact development method will be described.

Figure 4B:
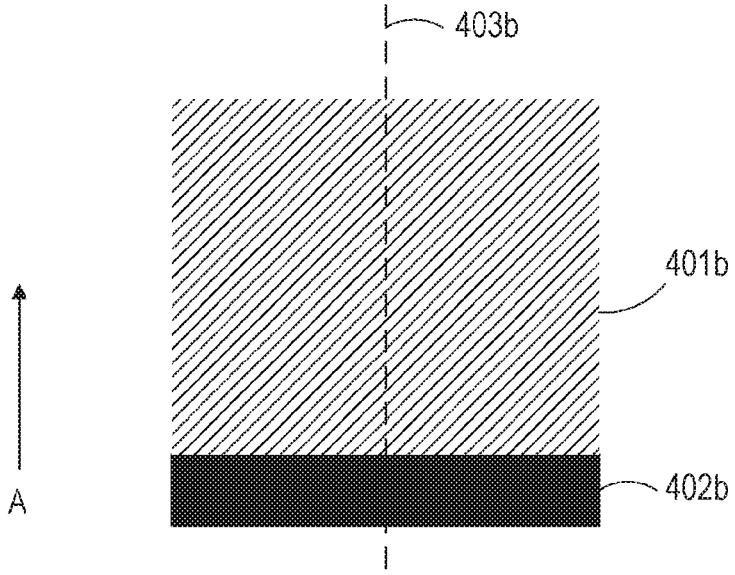
Figure 5B:
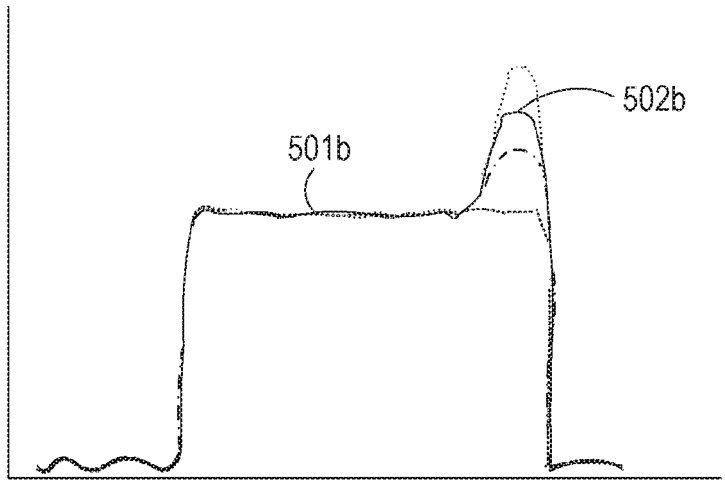

The sweeping is a phenomenon in which the developing agent 13 is concentrated on an edge of a rear end portion of an image on the photosensitive drum 1, and therefore, excessively-attached toner is generated. The rear end portion means a rear end portion in a direction in which a toner image is conveyed (the rotation direction of the photosensitive drum 1) which is denoted by the arrow mark A in the toner image. When the sweeping is generated, as illustrated in FIG. 4B, color density in an edge rear end portion 402*b* of a toner image 410 becomes higher than that in a non-edge portion 401*b*, and accordingly, a consumption amount of the developing agent 13 is increased. FIG. 5B is a diagram illustrating heights of the attached toner. A reference numeral 501*b* in FIG. 5B corresponds to the non-edge portion 401*b* and a reference numeral 502*b* corresponds to the edge portion 402*b*.

Figure 6:
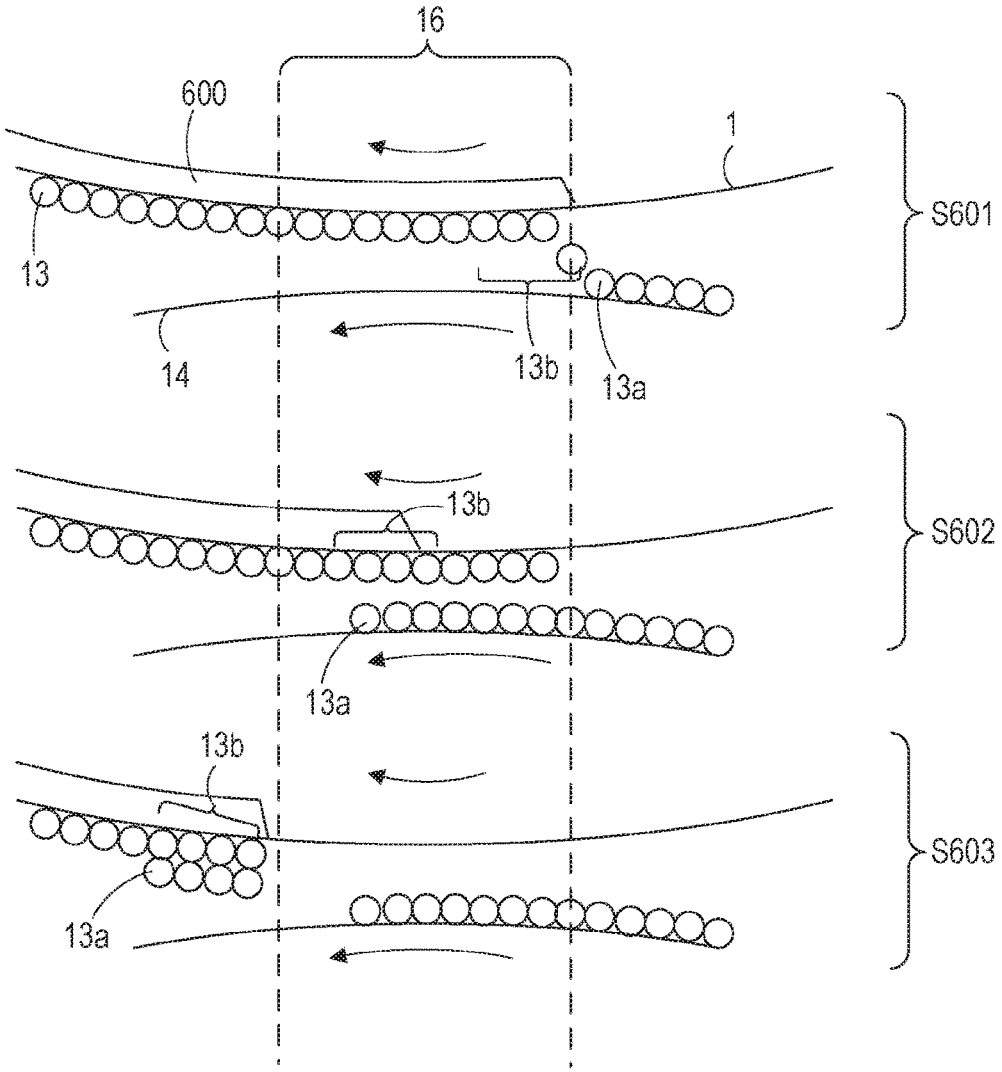
FIG. 6 is a diagram illustrating a mechanism of generation of sweeping.

In the contact development method, as illustrated in FIG. 6, a rotation speed of the developing roller 14 is higher than that of the photosensitive drum 1 so that a predetermined height of the toner on the photosensitive drum 1 is obtained. By this, the developing agent 13 may be stably supplied to the photosensitive drum 1, and target image density is maintained.

As denoted by reference numeral S601, an electrostatic latent image is developed in the developing region 16 by the developing agent 13 conveyed by the developing roller 14. Furthermore, since the rotation speed of the developing roller 14 is higher than that of the photosensitive drum 1, the positional relationship between the surface of the developing roller 14 and the surface of the photosensitive drum 1 are continuously shifted from each other. At a time when a rear end portion of an electrostatic latent image 600 enters the developing region 16, a developing agent 13*a* on the developing roller 14 is located on a rear side relative to a rear end portion 13*b* of the electrostatic latent image 600 in a start position of the developing region 16 in a rotation direction as denoted by the reference numeral S601.

Thereafter, by the time when the rear end portion 13*b* of the electrostatic latent image 600 leaves the developing region 16, the developing agent 13*a* on the developing roller 14 overtakes the rear end portion 13*b* of the electrostatic latent image 600 as denoted by a reference numeral S602.

Then, the developing agent 13*a* in the non-printing region which has caught up with the rear end portion 13*b* is supplied to the rear end portion 13*b* of the electrostatic latent image 600 as denoted by a reference numeral S603, and therefore, a toner amount in the rear end portion 13*b* is increased.

This is a mechanism of generation of the sweeping.

Method for Controlling Exposure Device

An exposure light amount is to be controlled in a unit of pixel for reduction of a toner consumption amount or control of an exposure amount for image processes.

A semiconductor laser used as an exposure unit generates heat by continuous light emission, and the heat causes expansion and contraction of a distance between resonant mirrors and a change of a resistance value. The expansion and contraction of the distance between the resonant mirrors causes a change of an oscillation frequency and the change of a resistance value causes a change of a light amount, and therefore, stabilizing control is performed when the semiconductor laser is used. Furthermore, a light receiving element used for light-amount feedback is integrally disposed on the semiconductor laser.

However, such stabilizing control mechanisms may not be used for pixel modulation. In general, the stabilizing control is performed by emitting light in the non-printing region in optical scanning and feeding back a light amount by the light receiving element, and therefore, correction is slowly performed in a unit of scanning line.

Since the light amount may not be changed and stabilized in such a short time that one pixel is rendered, another method is used for performing light amount control on individual pixels.

In general, an exposure light amount is controlled in a unit of pixel by controlling a light emission time for one pixel.

Specifically, pulse-width modulation (PWM), pulse-number modulation (PNM), an application of the PWM, an application of the PNM, a light emission pattern selection method, or the like is used. The PWM is a method for changing a length of a light emission time in a pixel. The PNM is a method for controlling a light amount by the number of pulses which are generated by a pulse generation unit and which are sufficiently shorter than a light emission time for one pixel. In a light-emission-pattern registering method, pixels are divided in a unit of 8 pixels, 16 pixels, 32 pixels, or the like in a main scanning direction, and the pixels are selected as a light emission pattern of the pixels.

PWM modulation and PNM modulation may require a high cost since an analog circuit of high accuracy is used for pulse interval control. The light-emission-pattern registering method may be realized only by a high-speed operation of a logic circuit, and a PWM pattern and a PNM pattern may be imitated although the number of patterns is small. In addition, the light-emission-pattern registering method is frequently employed since a much lower cost and much higher memory efficiency are realized in practice when compared with a case where image data of high resolution in the main scanning direction is used.

Method for Correcting Exposure Amount

As a method for easily specifying a correction value of a light amount, image data may be converted into multivalued image data and multivalued numerical values of individual pixels may be determined as correction values. The multivalued image data is obtained by performing various image processes on the image data, pixel values are converted into pulse lengths, the number of pulses, and a pattern, and the semiconductor laser is driven so that an exposure light amount in a latent image having a photosensitive drum shape is controlled.

Figure 7:
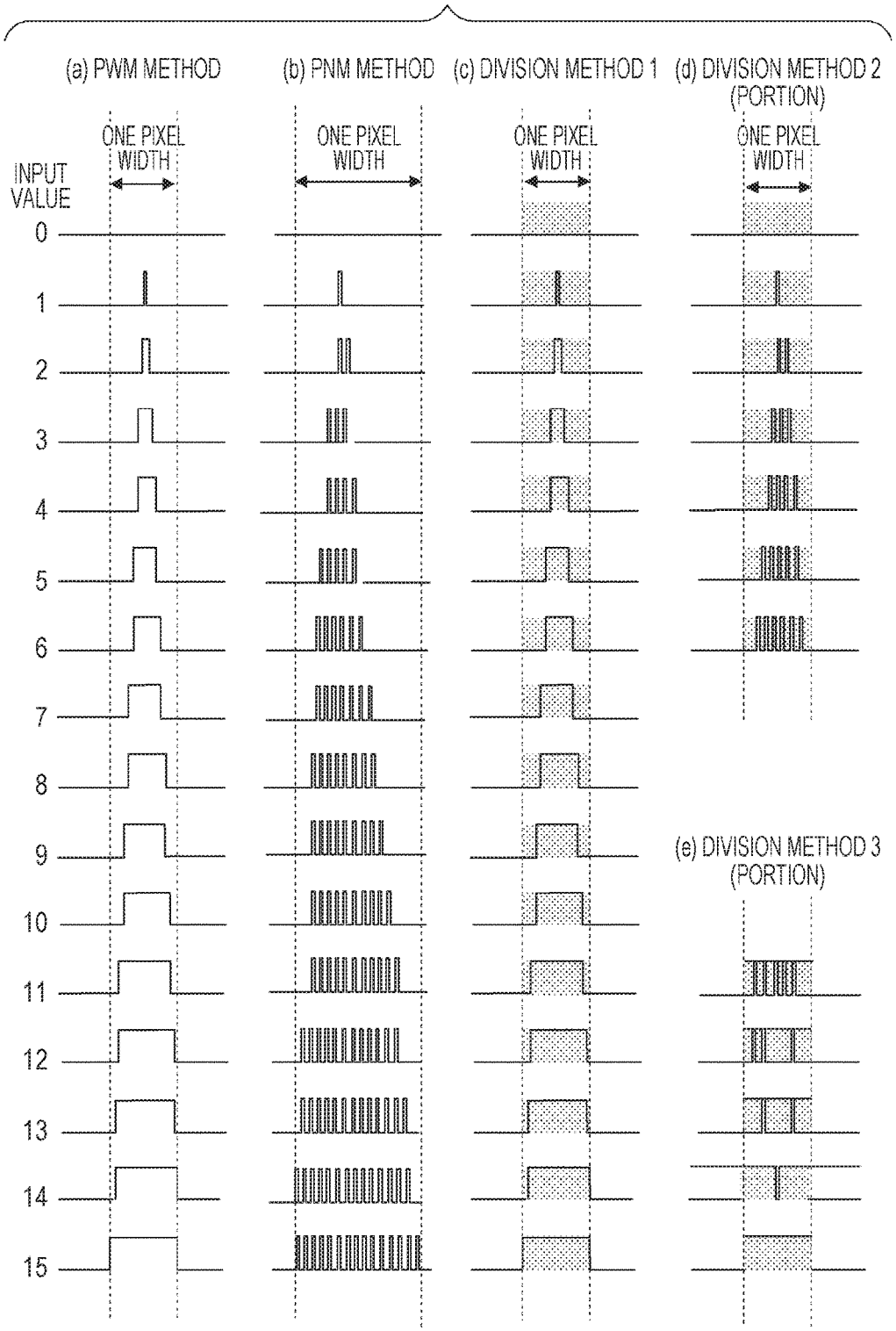
FIG. 7 is a diagram illustrating various methods for light amount correction.

Various conversion methods are illustrated in FIG. 7. In FIG. 7, rendering patterns of individual pixels are determined in accordance with pixel values which have been subjected to a multi-value process of 16 values.

(a) of FIG. 7 represents an example of a conversion waveform of the PWM method. A waveform in which a light emission time is increased in accordance with an input value is set.

(b) of FIG. 7 represents an example of a conversion waveform of the PNM method. When the PNM method in which a light amount is increased in accordance with the number of pulses is compared with the PWM method, the PNM method is beneficial in that pulse widths are fixed, and therefore, a cost is low. However, on/off frequency of a signal is high, and accordingly, the PNM method may have disadvantage in terms of electromagnetic wave noise. The PNM is frequently used in a light emitting element array which performs rendering of pixels at comparatively low speed when compared with a printing apparatus of an optical scanning type using laser light. The light emitting element array has variation among individual light emitting elements, and light amounts are to be corrected in the light emitting element array.

(c) to (e) of FIG. 7 represent conversion waveforms of division methods.

(c) of FIG. 7 represents an example of a pattern setting simulating the PWM. Other modulation methods may be simulated. Although a 16-division method is illustrated in FIG. 7, simulation in 16 values and simulation in 8 values may be performed in the PWM method and the PNM method, respectively. In (d) of FIG. 7, an example of simulation of the PNM method is illustrated.

Furthermore, in (e) of FIG. 7, an example of a pattern frequently used in correction of an exposure amount is illustrated. The pattern example is a type of an inverse PNM method, and a light amount is suppressed by extracting pulses from pixels of full lighting.

As described above, the division method is beneficial in that an efficient one of a large number of patterns may be distinguished and selected with a small number of multivalued data. If only a setting value is changed, other methods may be coped with while characteristics of the development method are easily followed.

In a case where the same pattern is directly held as binary image data, a 16-fold image data is used in the 16 division method illustrated in FIG. 7. However, only fourfold image data is used for multivalued image data of 16 values.

Procedure of Correction of Edge Effect

In both of the edge effect and the sweeping, a target region of light amount correction is detected, a value of multivalued image data in the detected target region is modified, a correction value is set, and the multivalued image data including the correction value is rendered so that the image data which has been subjected to the light amount correction is output.

Here, a case where the edge effect is reduced by correcting image data for forming an electrostatic latent image so that a consumption amount of the developing agent 13 is reduced will be described as an example.

The relationship between a condition of physical parameters and the like which correlate with the edge effect and the correction value of the exposure amount for reducing the edge effect is obtained in advance by experiment or simulation and is stored.

A processing method of correcting the edge effect will be described with reference to FIG. 9. Functional configuration units illustrated in FIG. 9 may be realized when the CPU 10 or the ASIC 18 reads programs stored in a storage unit. Accordingly, the correction process for reducing the edge effect is performed by the CPU 10 or the ASIC 18 included in the image calculation unit 9. It is assumed here that the CPU 10 performs the correction process.

In the process of correcting the edge effect, values of pixels in image data in which the edge effect or the sweeping of a toner may occur among a plurality of pixels constituting the image data are corrected so as to reduce the edge effect of the toner.

The correction process includes a step of specifying pixels to which a toner excessively adheres due to the edge effect or the sweeping of the toner among the plurality of pixels constituting the image data.

The correction process may further include a step of obtaining a pixel region constituted by pixels having pixel values equal to or larger than a predetermined value among the plurality of pixels constituting the image data and specifying a predetermined number of pixels located in an edge of the pixel region as pixels to which the toner excessively adhere due to the edge effect.

The same pixel determination conditions for retrieving pixels to be processed are employed in both of the edge effect and the sweeping.

(a) A target pixel is included in a continuous rendering region.

(b) The target pixel is located within a predetermined distance from an end portion of the rendering region.

(c) A non-rendering region spreads in a certain area from the end portion of the rendering region in a direction opposite to the rendering region.

The end portion is limited to a rear end in the case of the sweeping, and setting values of the predetermined distance in (b) in the sweeping and the edge effects are different from each other. However, the three conditions are required in common.

Figure 10:
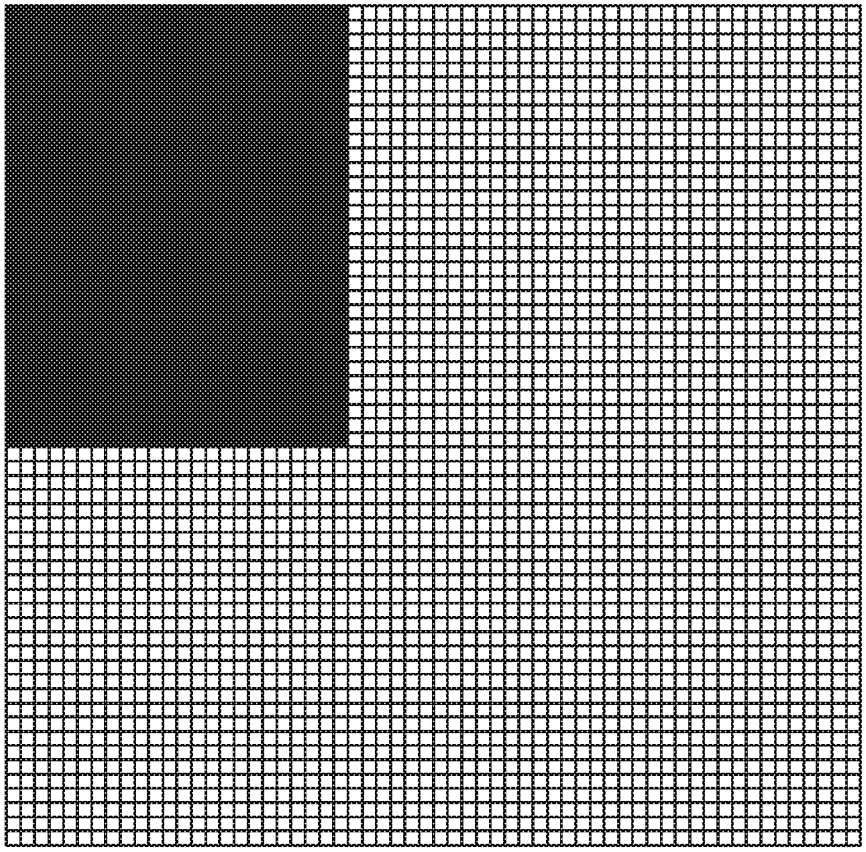
FIG. 10 is a diagram illustrating a rendering region.
Figure 11:
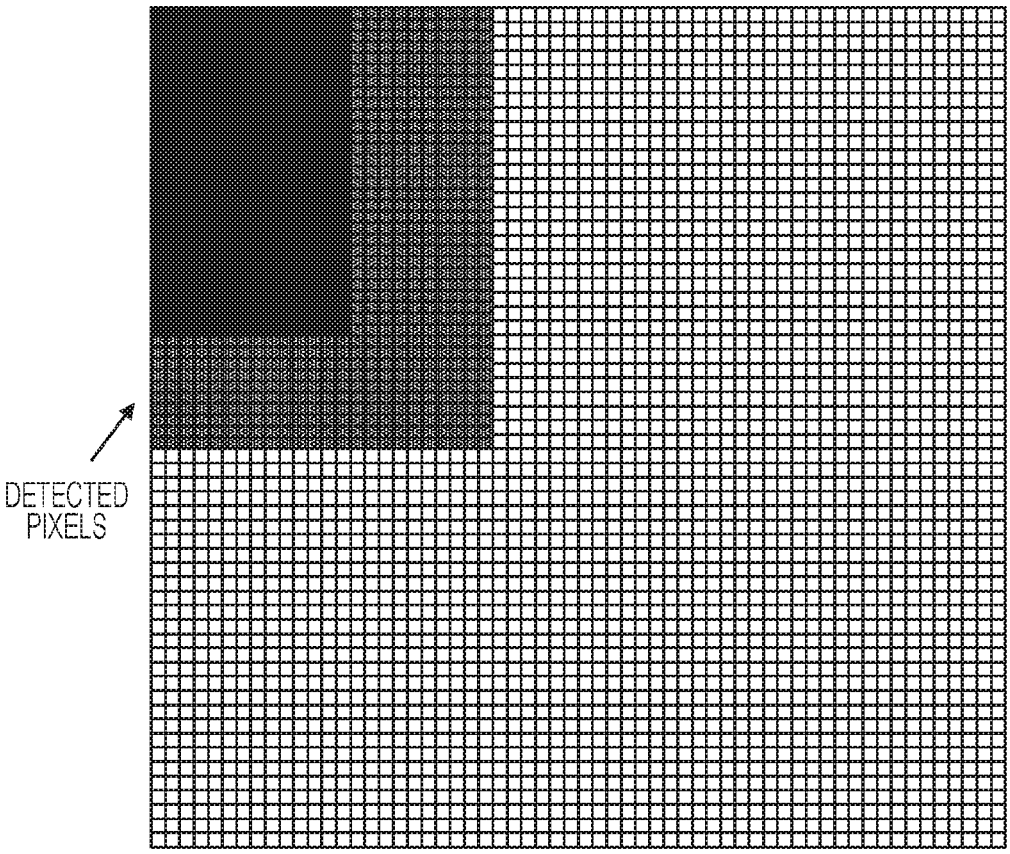
FIG. 11 is a diagram illustrating a determination region relative to the rendering region.
Figure 12:
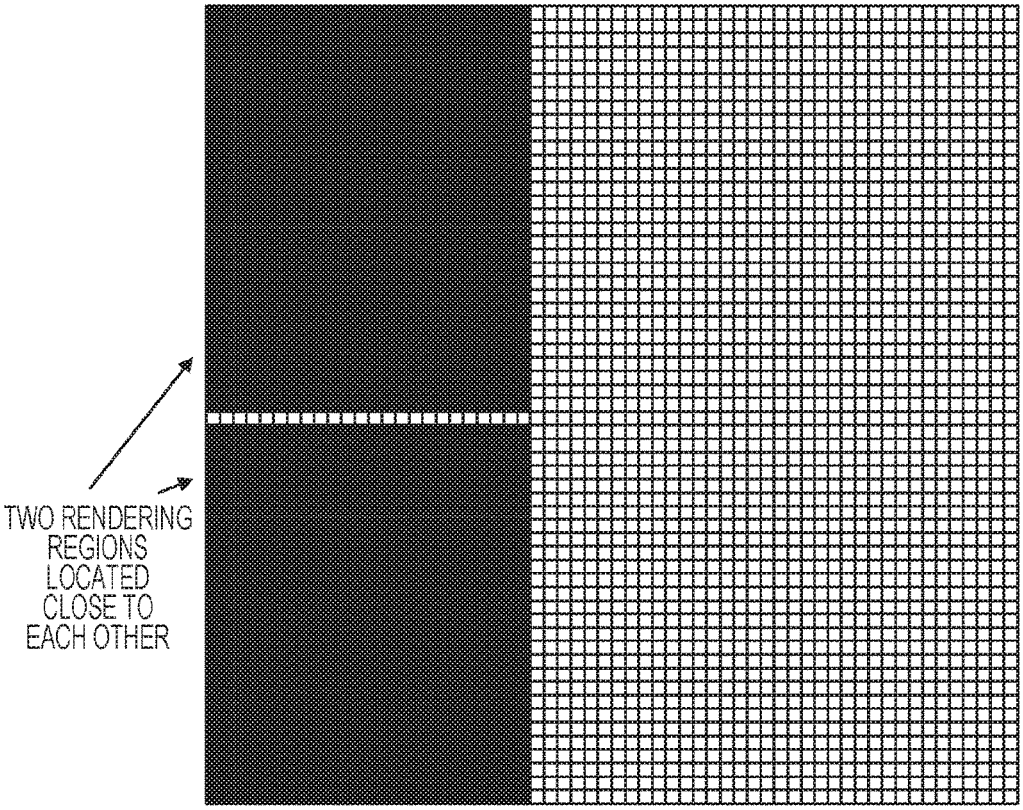
FIG. 12 is a diagram illustrating two rendering regions closely arranged.
Figure 13:
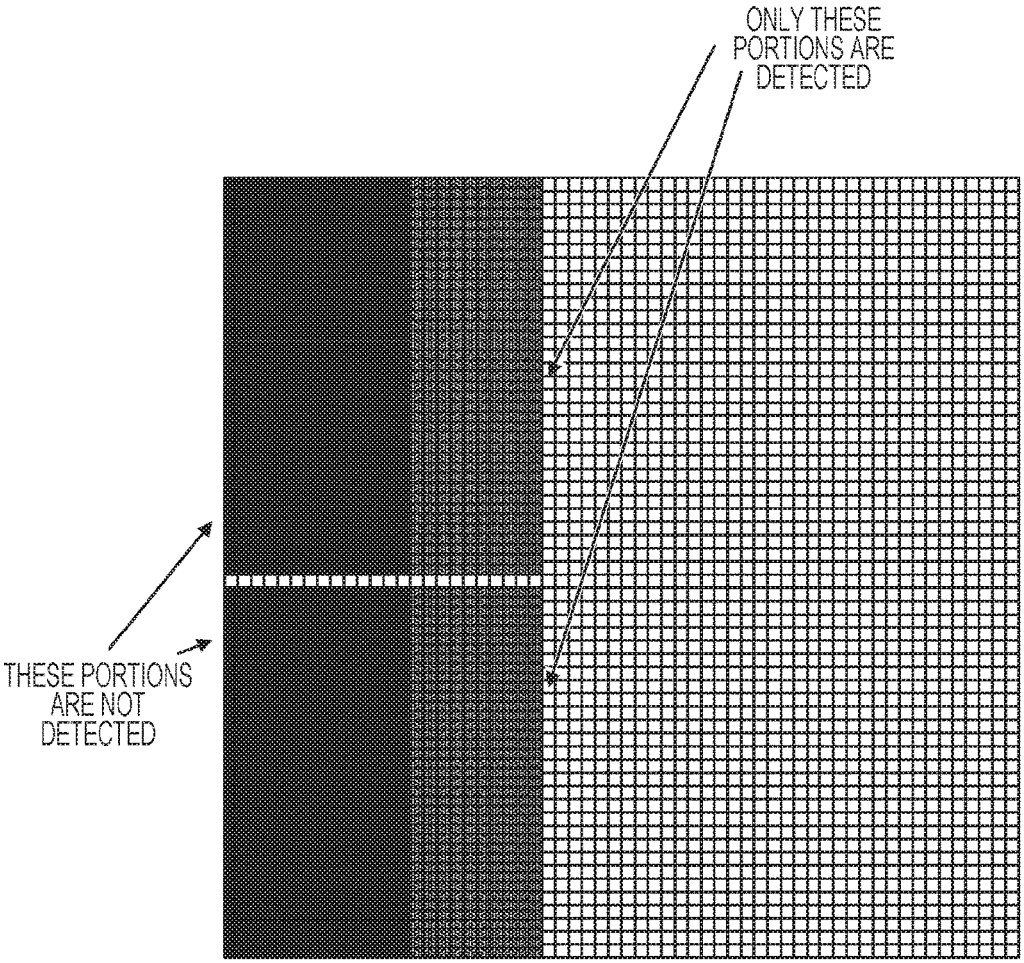
FIG. 13 is a diagram illustrating determination regions relative to the rendering regions of FIG. 12.

The first and second conditions (a) and (b) are set for detection of a portion to which the toner may excessively adhere in practice. The third condition (c) is set for a determination as to whether a blank region which receives the excessively-attached toner exists. In a case where the non-printing region does not spread in a certain area in a neighboring region, a region which receives an excessively-attached toner does not exist, and accordingly, color density is not increased. To avoid a setting of such a region as the target region, the spread in a certain area of the non-printing region is to be determined. In a rendering region illustrated in FIG. 10, in a case where the predetermined distance is 10, pixels are detected as illustrated in FIG. 11. However, in a case of two rendering regions which are located close to each other as illustrated in FIG. 12, portions which are located close to each other are not detected as illustrated in FIG. 13.

A correction value is determined in accordance with a distance from an end portion and a correction width parameter.

An actual processing flow will be described with reference to FIG. 9. First, rendering information 930 transmitted from the host computer 8 is developed and a printing image is developed in the mage memory 111 by an image data generation unit 900. Image data 931 is supplied to a toner-excessive-adhesion correction processor 905 which is a unique processor of the present invention and an existing image processing system after a contour correction processor 901 described hereinafter.

Image data 933 which has been modified for edge effect correction by the toner-excessive-adhesion correction processor 905 is further modified by a pixel selection unit 903 so that image data 935 for light amount correction is generated. The pixel selection unit 903 generates the image data 935 for driving a light amount modulation unit 904 using a processing result 934 of the existing image processing system and the image data 933.

In this way, by correcting exposure intensity of the pixels, the edge effect is reduced and a consumption amount of the developing agent 13 is reduced. The correction width parameter used in the toner-excessive-adhesion correction processor 905 indicates the number of pixels from the edge of the image region in which the toner is used and correction values corresponding to positions of the pixels.

Furthermore, the correction width parameter is not a simple numerical value but has a table structure representing a distance function and a correction amount in which the value is changed depending on a distance from the edge.

FIG. 8A is a diagram illustrating a correction table. In a case of a configuration in which a gradation value per pixel is small, a large number of rows may be arranged as illustrated in FIG. 8B so that correction values in the individual rows may be alternately employed so that the gradation values are increased in a pseudo manner.

FIGS. 5A and 5B are diagrams illustrating toner heights corresponding to the toner images illustrated in FIGS. 4A and 4B. In FIGS. 5A and 5B, a horizontal axis denotes a distance and a vertical axis denotes a tonner adhesion height. In FIG. 5A, a toner height corresponding to the toner image of FIG. 4A indicating the edge effect is illustrated. In FIG. 5B, a toner height corresponding to the toner image of FIG. 4B indicating the edge effect is illustrated. As illustrated in FIGS. 5A and 5B, correction amounts of a light amount for toner excessive adhesion are different depending on a distance, and therefore, a parameter array suitable for the distance is provided.

Correction of Sweeping

Correction of the sweeping is substantially the same as the correction of the edge effect. The correction is performed only on an image lower end direction. A right side of FIG. 5B corresponds to the lower end direction.

The CPU 10 and the ASIC 18 perform, in addition to the process of correcting excessive adhesion of the developing agent 13, such as a toner, described above, image generation, a process of correcting image data in accordance with characteristics of a printing mechanism, and various processes for improving image quality.

Next, an image processing technique relating to an adhesion amount of the developing agent 13, such as a toner, will be described.

Contour Correction

As rendering resolution of the printing mechanism is increased, an image of higher quality may be provided. However, the increase in the resolution increases costs of all components included in the printing apparatus employing the electrophotographic method. If the resolution is doubled, an amount of memory to be used is increased fourfold, and accordingly, the laser element is used to perform rendering at fourfold speed.

Consequently, a method for setting the rendering resolution so that an appropriate cost of the printing mechanism is attained and enhancing the resolution by an image process is employed.

The contour correction technique is one of such methods.

In printing apparatuses employing the electrophotographic method and fabricated in a low cost, a level difference between pixels in a contour in a rendered image may be visibly recognized. Accordingly, the level difference in the contour is corrected and a contour which is the same as that obtained by a printing apparatus which realizes high resolution is realized by extracting the contour and adding intermediate value pixels to a level-difference portion of the contour or replacing contour pixels by intermediate value pixels. As a result of the processing, image data including halftone pixels in an end portion of a rendering region is generated.

Registration Correction

In printing apparatuses fabricated in a low cost, a mechanical tolerance which may require a high cost is widely set and a generated printing distortion is corrected by correction of digital data.

In laser light scanning type printing apparatuses employing a tandem color method fabricated in a low cost, for example, scanning tracks of individual colors are not parallel to one another, and different color shifts are generated in different printing regions in a case where printing is performed without correction. Even in the light emitting element array, scanning tracks of individual colors are not parallel to one another in terms of attachment accuracy, and accordingly, color shifts by some pixels or so are generated.

For example, in a case where phases of color plates in a right end are the same as one another, cyan is shifted to a lower side by three pixels and magenta is shifted to an upper side by two pixels in a left end, and yellow is shifted by four pixels at a center. To correct this phenomenon, distortion characteristics of individual machines are recorded in the machines themselves in advance and deformation is applied to an image to cancel the distortion so that printing positions of the individual colors match one another.

Examples of a method for deforming an image include a method for simply shifting an image by one pixel in several positions and a method for applying weights to information on two scanning lines which are adjacent to each other and determining a result of addition of resultant values of the weighting as an output image.

In a case where shift by one pixel is simply performed, a level difference by one pixel is generated which makes attention in the contour portion of the rendering region, and accordingly, a contour correction process is performed.

A sum of weighting coefficients is 1. In a case where a blend function is generated by performing weighting addition on the image of the two scanning lines and a blend image is generated using this blend function, the same result of the addition may be obtained in a region in which plain regions are consecutively arranged and a region in which rendering regions are consecutively arranged whereas an intermediate value is generated in a boundary region in accordance with a change of a weighting coefficient.

In any processing result, intermediate value pixels are arranged in the contour portion of the rendering region and the other pixels have a value of 0 or are saturated, that is, have a maximum value.

Halftone Dot Processing

In gradation expression of the electrophotographic method, shading is represented by an area ratio of a non-rendering region which is a small region to a rendering region. The rendering region and the non-rendering region are individually configured as clusters for stabilizing expression and form halftone dots.

In a case where the number of pixels included in the small region is small, the sufficient number of gradation levels may not be expressed whereas in a case where the small region is large, detailed portions of the image are lost. Therefore, a printing apparatus attaining high resolution is beneficial in the gradation expression. In a case where intermediate value expression may be realized by controlling light amounts in the individual pixels, the number of gradation levels which may be expressed in the small region is increased, and gradation expression which is the same as a printing apparatus which realizes high resolution may be realized even in a printing apparatus which realizes low resolution.

For growth of the halftone points, a method for gradually replacing pixels in the end portion by pixels having large light amounts, and gradually increasing light amounts of the other pixels when the light amounts of the pixels in the end portion reach maximum values is employed. As a result, an image which has been subjected to the halftone dot processing includes a small number of intermediate value pixels in end portions of the individual halftone dots and a number of pixels saturated to maximum values in most portions of the halftone dots.

Pseudo High-Resolution Process

If an electrophotographic latent image which is the same as that generated by a printing apparatus which realizes high resolution may be generated even in a printing apparatus which realizes low resolution, an image of the same level as an image generated by the printing apparatus which realizes high resolution may be generated by the printing apparatus which realizes low resolution.

In the printing apparatus which realizes low resolution, an electrophotographic latent image which is similar to that generated by the printing apparatus which realizes high resolution is generated by providing a configuration capable of controlling light amounts in individual pixels, performing rendering of image data of high resolution, and determining light amount values of printing pixels in accordance with a sum of rendering pixels of high resolution in a group (or a weighting calculation) when output is performs by the printing mechanism which realizes low resolution.

Although a result of pseudo high-resolution processing is the same as image data of low resolution in most regions, halftone pixels exist in the contour portion.

Furthermore, a large number of character images of small characters having a large number of fine structures, for example, are constituted only by halftone pixels.

Selection of Processing Result

As described above, a general technique may be employed in image processes other than the process of correcting excessive adhesion of the developing agent 13, such as a toner, and most results of the image processes represent that halftone pixels are included in a contour portion in a rendering region. Accordingly, when the image processes and the process of correcting excessive adhesion of the developing agent 13 are simultaneously realized, effective results may be expected by focusing storage of halftone pixels in a boundary region.

By giving priority levels to the halftone pixels in a boundary region, the process of correcting excessive adhesion of the developing agent 13 may be introduced without interference with the other image processes.

A processing range of the process of correcting excessive adhesion is a range from approximately 15 pixels to approximately 30 pixels from an end portion of a rendering region depending on a development method. Although this region also includes pixels in a boundary between a printing region and a non-printing region, a rate of the region is less than 10% of an entire processing range of the process of correcting excessive adhesion in the pixels in the boundary. Even if the boundary pixels are removed, a sufficient number of pixels to be subjected to the correction exist, and accordingly, a sufficient effect of the process of correcting excessive adhesion is expected.

Accordingly, at least one of a rendering-region boundary detection circuit and a pixel intermediate-value detection circuit is provided, and results of the process of correcting excessive adhesion of the developing agent 13 in pixels detected by these detection circuits are not employed.

On the other hand, results of the process of correcting excessive adhesion of the developing agent 13 may be employed in pixels which are not detected by the detection circuits, and image processing results including both of the results may be generated and the printing mechanism may be driven.

Figure 14:
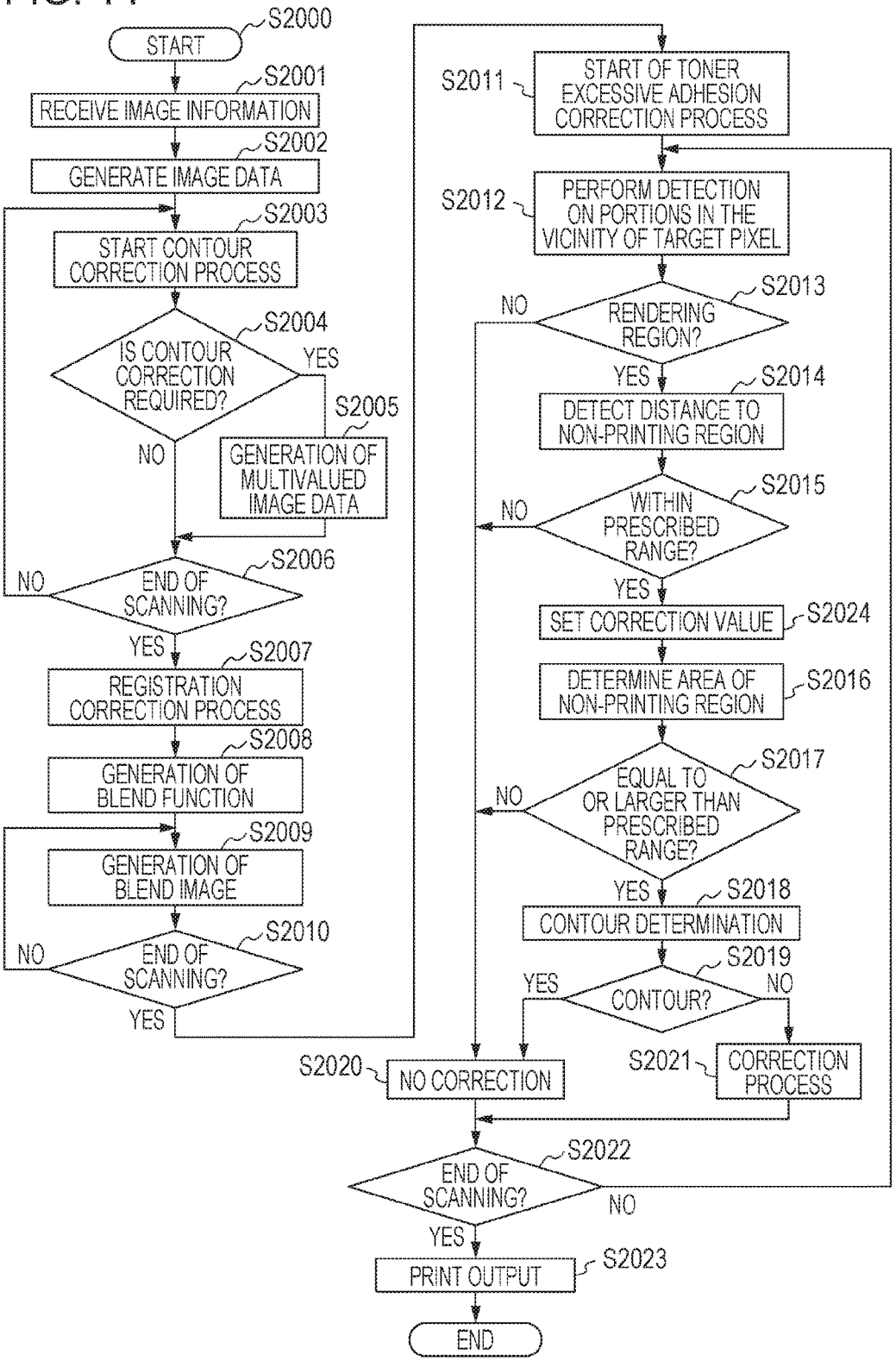
FIG. 14 is a flowchart illustrating a control method according to the present invention.

An operation flow of a print control method of this embodiment will be described with reference to a flowchart of FIG. 14.

This control operation is executed when the CPU 10 or the ASIC 18 reads a program stored in the storage device 11 or another storage device not illustrated.

Figure 9:
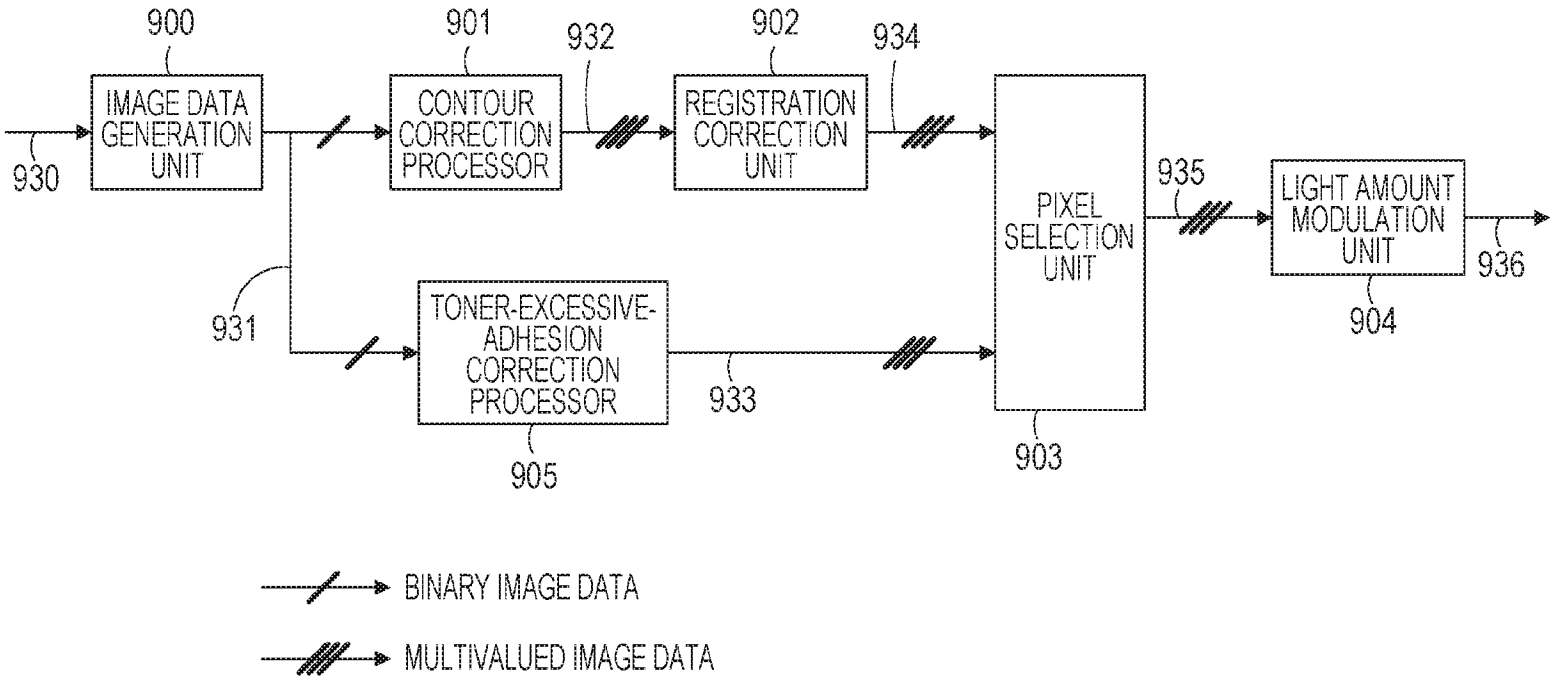
FIG. 9 is a diagram illustrating an image data process.

Furthermore, although emulation is physically performed by the CPU 10 and the ASIC 18, a logical block configuration is illustrated in FIG. 9.

In this operation flow, the contour correction and registration correction are performed with the process of correcting excessive adhesion as an image process.

In step S2000, the CPU 10 and the ASIC 18 starts operation in response to a start instruction and the process proceeds to step S2001.

The image data generation unit 900 receives the image information 930 from the host computer 8 in step S2001, and thereafter, generates image data 931 in the image memory 111 in step S2002.

When the generated image data 931 is supplied to the contour correction processor 901, the contour correction processor 901 starts the contour correction process in step S2003 so that an image is scanned and a region to be subjected to the contour correction process is searched for by pattern matching in step S2004.

Subsequently, the contour correction processor 901 performs a process of generating intermediate value pixels in step S2005 on the region determined in step S2004 as the region is to be subjected to the contour correction process so as to generate multivalued image data 932. Then the process proceeds to step S2006.

When it is determined that the contour correction process is not to be performed in step S2004, the process proceeds to step S2006.

In step S2006, the CPU 10 and the ASIC 18 determines whether the scanning has been terminated. When the determination is negative, the process returns to step S2003. When the determination is affirmative, the process proceeds to step S2007.

In step S2007, a registration correction unit 902 starts registration correction on the image data 932 input to the registration correction unit 902 after becoming multivalued data in step S2005 and being scanned in step S2006. Then the process proceeds to step S2008.

In step S2008, the registration correction unit 902 obtains a registration position, generates a blend function by performing a weighting process on image data corresponding to two scanning lines from a coordinate of the registration position. Thereafter, the process proceeds to step S2009. In step S2009, the blend image 934 is generated using the blend function.

When determining that the data scanning has been terminated in step S2010, the CPU 10 and the ASIC 18 terminates procedures of the image processes of a contour correction system and provides image data before the process of correcting toner excessive adhesion is performed by the toner-excessive-adhesion correction processor 905 in step S2011 starting from the image data 931 generated in step S2002.

The process from step S2011 onwards is a flow of the toner excessive adhesion correction process.

After the image processes of the contour correction system are terminated, the CPU 10 and the ASIC 18 start the toner excessive adhesion correction process in step S2011. As the entire flow, an image determination process of performing scanning and selecting a pixel to be subjected to the toner excessive adhesion correction process is performed in step S2012 to step S2017 and step S2024. Thereafter, in step S2018 and step S2019, it is determined whether the pixel determined as a possible pixel to be subjected to the toner excessive adhesion correction process has been subjected to the contour correction.

The toner-excessive-adhesion correction processor 905 which receives the image data 931 detects a pixel in the vicinity of the target pixel by scanning an image input in step S2012 and determines whether the pixel in the vicinity of the target pixel is included in a rendering region in step S2013. When the pixel in the vicinity of the target pixel is not included in the rendering region (No in step S2013), the pixel is not to be corrected and the process proceeds to step S2020.

The toner-excessive-adhesion correction processor 905 determines a distance in which the pixel in the vicinity of the target pixel determined to be included in the rendering region in step S2013 becomes part of a non-printing region in step S2014 and determines whether the distance in which the non-printing region is detected is within a prescribed range in step S2015. When the determination is affirmative, the process proceeds to step S2024.

When the determination is negative, the pixel is not to be corrected, and the process proceeds to step S2020 (No in step S2015).

In step S2024, the toner-excessive-adhesion correction processor 905 sets a correction value using the distance determined in step S2014 and the correction width parameter provided in advance to the pixel in which the non-printing region is detected within the prescribed range, and the process proceeds to step S2016.

Subsequently, the toner-excessive-adhesion correction processor 905 performs a process of determining whether spread of the non-printing region is equal to or larger a prescribed region (S2016). When the spread of the non-printing region is not equal to or larger than the prescribed region as illustrated in FIG. 12 (No in step S2017), the toner does not adhere, that is, the correction is not performed, and the process proceeds to step S2020.

When the spread of the non-printing region is equal to or larger than the prescribed region (Yes in step S2017), the process proceeds to step S2018.

As a result of the process described above, the toner-excessive-adhesion correction processor 905 generates the multivalued image data 933 including the correction target pixel and the correction value.

Thereafter, the pixel selection unit 903 performs the contour determination process on the multivalued image data 933 and the blend image 934 so as to perform pixel selection of determining whether the target pixel is included in a contour (S2018).

When the pixel selection unit 903 determines that the target pixel is included in the contour, it is possible that another image process has been performed, and therefore, if the toner excessive adhesion correction process is performed, an effect of the image process performed on the original image may be lost. Accordingly, in this case, the target pixel is not a correction target of the toner excessive adhesion correction process (Yes in step S2019), and therefore, the process proceeds to step S2020. When it is determined that the target pixel is not included in the contour, the process proceeds to step S2021.

The toner excessive adhesion correction process is not performed on a pixel which is not a correction target (S2020).

Here, although a general edge detection process may be performed as the contour determination in step S2018, in addition to the general edge detection process, a determination as to whether an intermediate value which is not 0 or a maximum value is detected may be employed as a contour determination condition for the result of the image process from step S2003 to step S2010 in the present invention. This is because the intermediate value generated by these image processes is included in the contour portion. The intermediate value means that another image process has been already performed.

In a case where a function shape of the correction width parameter has a recessed characteristic and a correction amount of toner excessive adhesion to a contour pixel is set to small as illustrated in FIG. 8A, detection of only halftone pixels is sufficient.

Figure 15:
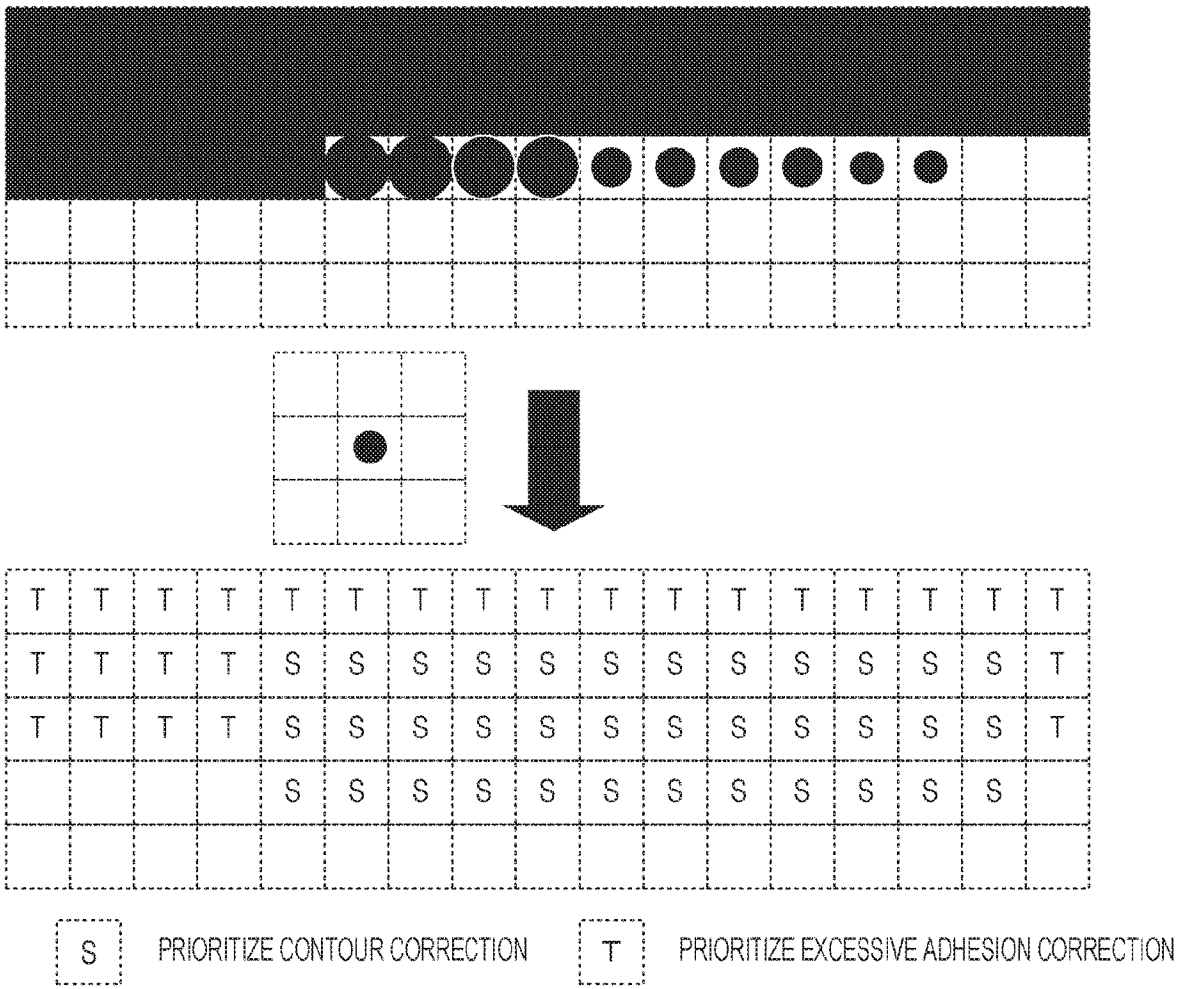
FIG. 15 is a diagram illustrating an intermediate value and selection of correction targets of neighboring pixels.

In a case where the correction width parameter is a monotonically decreasing function, the general edge detection process is also performed or a contour correction processing value is employed as well as the intermediate values in neighboring 8 pixels of intermediate values as illustrated in FIG. 15.

In step S2021, the CPU 10 and the ASIC 18 of the pixel selection unit 903 convert the pixel of the correction target which is not determined as the contour in step S2019 into the multivalued image data 935 based on the image data 933 including the correction target pixel and the correction value.

When the scanning is terminated in S2022, the light amount modulation unit 904 performs light amount modulation on the multivalued image data 935. Then the light amount modulation unit 904 selects a light amount modulation pattern and drives the laser by the pattern so that printing output is performed using a corrected exposure light amount 936 (S2023). The process is thus terminated.

According to this embodiment, an image forming apparatus which employs an electrophotographic method and which simultaneously realizes efficient use of a toner and improvement of printing quality by performing control of suppression of toner excessive adhesion which occurs when the electrophotographic method is employed and control of suppression of interference of a general image process.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-005181, filed Jan. 14, 2015 which is hereby incorporated by reference herein in its entirety.

What is claimed is:

1. An apparatus including an image bearing member, a charging unit which uniformly charges the image bearing member in accordance with image data, an exposure unit which exposes the image bearing member, a developing unit which develops an electrostatic latent image formed on the image bearing member using a developing agent conveyed by a developing agent bearing member, and a printing unit which prints the developed image, the apparatus comprising a processor and a memory containing instructions that when executed by the processor, cause the processor to perform operations comprising:

first correcting a pixel value of a pixel to be corrected included in the image data using a first correction method;

second correcting a pixel value of a pixel to be corrected included in the image data using a second correction method which is different from the first correction method;

determining the pixel to be corrected by the second correcting;

determining whether the pixel having the pixel value to be corrected by the second correcting has been corrected by the first correcting; and performing control such that when the pixel having the pixel value to be corrected by the second correcting has been corrected by the first correcting, the exposure unit performs exposure in accordance with image data corrected by the first correcting, and when the pixel having the pixel value to be corrected by the second correcting has not been corrected by the first correcting, the second correcting corrects the pixel value and the exposure unit performs exposure in accordance with image data corrected by the second correcting.

2. The apparatus according to claim 1, wherein the determining determines that a target pixel is to be corrected by the second correcting in a case where the target pixel satisfies the following conditions:

(a) the target pixel is included in a continuous rendering region;

(b) the target pixel is located within a predetermined distance from an end portion of the rendering region; and (c) a non-rendering region spreads in a certain area from the end portion of the rendering region in a direction opposite to the rendering region.

3. The apparatus according to claim 1, wherein the first correcting is a contour correcting which performs a process of correcting a contour of an image.

4. The apparatus according to claim 1, wherein the first correcting is a registration correcting which performs registration correction on an image.

5. The apparatus according to claim 1, wherein the second correcting is a correcting which performs a process of correcting toner excessive adhesion of an image.

6. The apparatus according to claim 5, wherein the process of correcting toner excessive adhesion is a process of correcting an excessively-adhering toner caused by an edge effect.

7. The apparatus according to claim 5, wherein the process of correcting toner excessive adhesion is a process of correcting an excessively-adhering toner caused by a sweeping effect.

8. A method employed in an apparatus including an image bearing member, a charging unit which uniformly charges the image bearing member in accordance with image data, an exposure unit which exposes the image bearing member, a developing unit which develops an electrostatic latent image formed on the image bearing member exposed by the exposure unit using a developing agent conveyed by a developing agent bearing member, and a printing unit which prints the developed image, the method comprising:

correcting a pixel value of a pixel to be corrected included in the image data as first correction;

correcting a pixel value of a pixel to be corrected included in the image data as second correction different from the first correction;

determining the pixel to be corrected in the second correction;

determining whether the pixel having the pixel value to be corrected in the second correction has been corrected in the first correction; and performing control such that when the pixel having the pixel value to be corrected in the second correction has been corrected in the first correction in the determining, the exposure unit performs exposure in accordance with image data corrected in the first correction, and when the pixel having the pixel value to be corrected in the second correction has not been corrected in the first correction in the determining, the pixel value is corrected in the second correction and the exposure unit performs exposure in accordance with image data corrected in the second correction.

9. The method according to claim 8, wherein the determining determines that a target pixel is to be corrected by the second in a case where the target pixel satisfies the following conditions:

(a) the target pixel is included in a continuous rendering region;

(b) the target pixel is located within a predetermined distance from an end portion of the rendering region; and (c) a non-rendering region spreads in a certain area from the end portion of the rendering region in a direction opposite to the rendering region.

10. The method according to claim 8, wherein the first correction is a contour correction which performs a process of correcting a contour of an image.

11. The method according to claim 8, wherein the first correction is a registration correction which performs registration correction on an image.

12. The method according to claim 8, wherein the second correction is a correction which performs a process of correcting toner excessive adhesion of an image.

13. The method according to claim 12, wherein the process of correcting toner excessive adhesion is a process of correcting an excessively-adhering toner caused by an edge effect or a sweeping effect.

14. A non-transitory computer readable storage medium storing a program for causing a computer to perform:

correcting a pixel value of a pixel to be corrected included in image data as first correction;

correcting a pixel value of a pixel to be corrected included in the image data as second correction;

determining the pixel to be corrected in the second correction different from the first correction;

determining whether the pixel having the pixel value to be corrected in the second correction has been corrected in the first correction; and performing control such that when the pixel having the pixel value to be corrected in the second correction has been corrected in the first correction in the determining, the exposure unit performs exposure in accordance with image data corrected in the first correction, and when pixel having the pixel value to be corrected in the second correction has not been corrected in the first correction in the determining, the pixel value is corrected in the second correction and the exposure unit performs exposure in accordance with image data corrected in the second correction.

15. The non-transitory computer readable storage medium according to claim 14, wherein the determining determines that a target pixel is to be corrected by the second in a case where the target pixel satisfies the following conditions:

(a) the target pixel is included in a continuous rendering region;

(b) the target pixel is located within a predetermined distance from an end portion of the rendering region; and (c) a non-rendering region spreads in a certain area from the end portion of the rendering region in a direction opposite to the rendering region.

16. The non-transitory computer readable storage medium according to claim 14, wherein the first correction is a contour correction which performs a process of correcting a contour of an image.

17. The non-transitory computer readable storage medium according to claim 14, wherein the first correction is a registration correction which performs registration correction on an image.

18. The non-transitory computer readable storage medium according to claim 14, wherein the second correction is a correction which performs a process of correcting toner excessive adhesion of an image.

19. The non-transitory computer readable storage medium according to claim 18, wherein the process of correcting toner excessive adhesion is a process of correcting an excessively-adhering toner caused by an edge effect or a sweeping effect.

* * * * *